United States Patent [19]

Collins

[11] 4,203,167

[45] May 20, 1980

[54] SIMULATED BELT BUCKLE AND APPENDAGE

[75] Inventor: Walter W. Collins, Rock Hill, S.C.

[73] Assignee: Jenkins Metal Corporation, Gastonia, N.C.

[21] Appl. No.: 965,563

[22] Filed: Dec. 1, 1978

[51] Int. Cl.[2] ..... A41F 9/00

[52] U.S. Cl. ..... 2/322; 24/204; 24/230 A; 24/265 R; 224/229

[58] Field of Search ..... 2/322, 321, 300, 301; 24/163 R, 265 BC, 163 KO, 230 A, 77 R, 204, 265 R, 265 WS; 224/2 D, 26 D, 26 E; 7/1 A, 1 B, 1 C

[56] References Cited

U.S. PATENT DOCUMENTS

| | | | |
|---|---|---|---|
| 1,958,643 | 5/1934 | Silverman | 24/163 R |
| 3,823,421 | 7/1974 | Collins | 2/321 |
| 3,823,422 | 7/1974 | Forgett, Jr. | 2/321 |
| 3,885,250 | 5/1975 | Schiller | 2/321 |
| 3,903,547 | 9/1975 | Schiller | 2/321 |
| 4,100,655 | 7/1978 | Langley | 2/322 X |

*Primary Examiner*—H. Hampton Hunter
*Attorney, Agent, or Firm*—Clifton T. Hunt, Jr.

[57] ABSTRACT

A simulated belt buckle adapted for use with a belt including means for releasably connecting its ends when encircling the waist of a wearer, said simulated belt buckle including a decorative plate portion and an appendage which may be in the form of a knife, a retaining stud extending inwardly from the inner surface of the plate, one end of said belt having a hole for reception of said retaining stud and a sheath having an opening adjacent said one end of the belt to receive the knife or other appendage on the simulated belt buckle, and means pivotally connecting the plate and knife for movement relative to each other, whereby a single manual movement will pivot the plate outwardly to remove the retaining stud from the hole and withdraw the knife from the sheath.

8 Claims, 6 Drawing Figures

SIMULATED BELT BUCKLE AND APPENDAGE

BACKGROUND OF THE INVENTION

This invention relates to a belt for encircling the waist of a person and more particularly to such a belt adapted for use with a readily removable imitation buckle carrying an appendage suitable for any desired use, such as a knife.

Belts with removable buckles having appendages which may be used as a knife, a key, a whistle, a screw driver, scissors or any other desired item are shown in several prior patents. In most instances the appendage on the buckle is a knife which is normally concealed within the belt but may be withdrawn when needed by persons feeling the need for self-defense such as police officers, military personnel and others wanting the assurance of self-defense that such a weapon provides.

One such device is shown in applicant's prior U.S. Pat. No. 3,823,421 issued July 16, 1974. One form of the invention illustrated in U.S. Pat. No. 3,823,421 is a belt buckle in the form of an open loop having a knife formed integral with and extending from one side of the loop of the belt. Straps extend from the ends of the belt through the loop and are fastened to the belt as by snap fasteners to hold the belt in place. The buckle and its attached knife may be removed from the belt by releasing the snap fasteners and withdrawing the knife from its pocket. Said U.S. Pat. No. 3,823,421 also discloses a removable belt buckle having a stud adapted to register with selected holes in the ends of the belt for holding the belt in place about the wearer's body. The buckle and its knife may be removed by lifting one end of the belt from the stud and passing it through the buckle, after which the buckle and its knife may be removed from the pocket on the inner surface of the outer end of the belt.

U.S. Pat. No. 3,823,422 issued July 16, 1974 to Valmore J. Forgett, Jr., U.S. Pat. No. 3,885,250 issued May 27, 1975 to Barry Schiller and U.S. Pat. No. 3,903,547 issued Sept. 9, 1975 to Barry Schiller all disclose removable belt buckles having knives or other appendages rigidly attached to the buckle and recieved within pockets within belts and the use of studs for retraining the buckle on the belt and the belt about a person's waist.

In each instance, one end of the belt must be drawn through the belt buckle before the belt buckle and its rigidly attached knife can be removed from the pocket in the other end of the belt. And an additional step is required to separate the retaining stud from the hole in the belt or buckle preparatory to withdrawing the appendage from its pocket. The consequent time delay in removing the knife from its pocket after the need arises is considered objectionable by those persons having an urgent need for self-defense.

SUMMARY OF THE INVENTION

According to the present invention, a simulated buckle comprising a decorative plate and a knife or other appendage are pivotally interconnected so that the decorative plate may be manipulated to quickly release the decorative plate from the belt and permit axial withdrawal of the knife from its sheath in a single motion. The simulated belt buckle and its knife play no part in holding the ends of the belt together about a person's waist. That function is provided by thistle cloth on the inner surface of one end of the belt and on the outer surface of the other end of the belt. The use of thistle cloth, or VELCRO, to prevent relative longitudinal movement between the two ends of a belt is shown in U.S. Pat. No. 3,866,276 and no novelty is claimed in the use of thistle cloth or VELCRO for this purpose. If desired, the ends of the belt may be held together by snap fasteners or other suitable means.

The invention also includes a belt loop extending about the overlying ends of the belt in use and movable to cover a retaining hole in one end of the belt when it is desired to wear the belt without the simulated buckle. The belt loop is freely slideable along the belt and is desirably retained on the belt in accordance with the invention by a keeper comprising an extension passing through a retaining strap fixed to the inner surface of the belt and the extension having an enlarged portion which will not pass through the retaining strap, thereby retaining the loop on the belt at all times when the belt is not in use.

DETAILED DESCRIPTION OF THE INVENTION

The simulated belt buckle comprises a decorative plate 10 which may be formed from brass, silver, gold or any other desired material and suitably engraved or otherwise decorated as desired. An appendage is illustrated as a knife blade 11 although it is to be understood that the appendage may be any desired item such as a cork screw, screw driver, key or any desired object without departing from the spirit of the invention. For purposes of illustration the appendage is illustrated and will be described as a knife blade.

Figure 1:
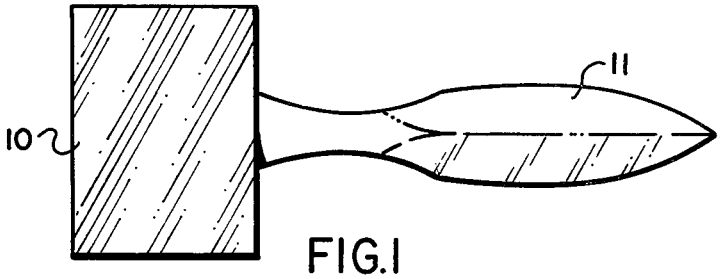
FIG. 1 is a plan view of the simulated belt buckle and its appendage in the form of a knife removed from the belt.
Figure 2:
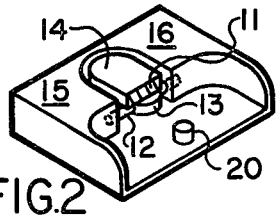
FIG. 2 is a perspective view looking at the bottom of the decorative plate illustrating the spring pressed pivotal connection and showing the illustrated knife blade in section.
Figure 3:
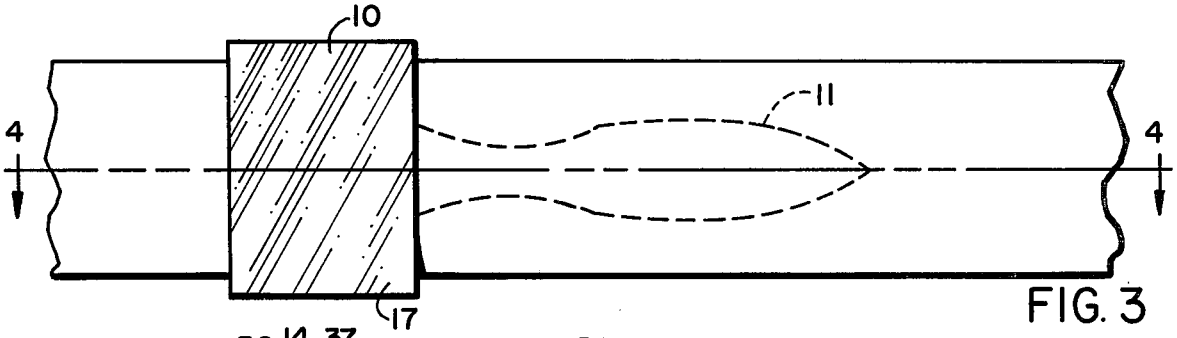
FIG. 3 is a plan view of the simulated belt buckle and knife-like appendage assembled on a belt.
Figure 4:
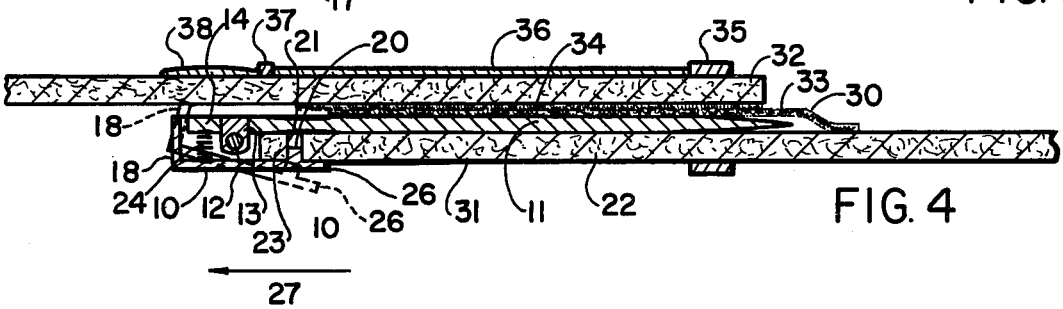
FIG. 4 is a vertical sectional view taken substantially along the line 4—4 in FIG. 3.
Figure 5:
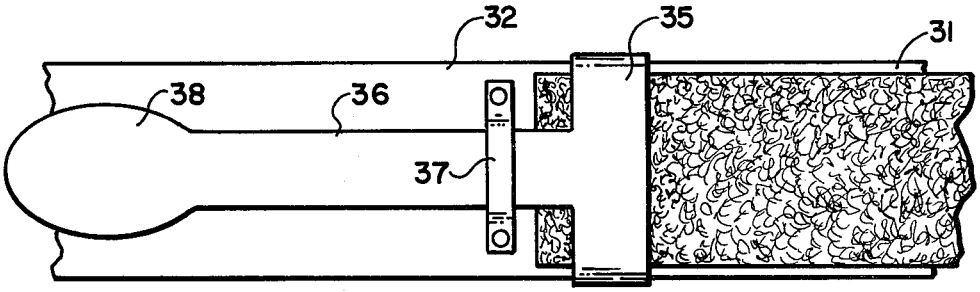
FIG. 5 is a plan view looking at the inner surface of a belt and illustrating the keeper for the belt loop.

The knife blade 11 is pivotally connected to the decorative plate 10 by a pivot pin 12 (FIGS. 2 and 4). The pin 12 loosely penetrates a lug 13 extending perpendicularly from the handle portion 14 of knife blade 11. The pin 12 is journaled in side walls 15 and 16 of decorative plate 10 (FIG. 2). The decorative plate 10 includes a top wall 17 and an end wall 18. A retaining stud 20 extends inwardly from top wall 17 for engagement with a locking hole or passageway 21 extending through a belt 22 adjacent its outer end 23. A coiled spring 24 extends between the top wall 17 of plate 10 and the end 14 of knife blade 11 to normally urge the free end 26 of top wall 17 inwardly to seat the retaining stud 20 within the hole 21 in belt 22.

Outward pressure on free end 26 of decorative plate 10 rotates the plate 10 about pin 12 relative to blade 11 and removes the retaining stud 20 from locking hole 21 without moving blade 11. When the decorative plate 10 has been pivoted to the dotted line position in FIG. 4 the stud 20 is free of hole 21 and continued movement of plate 20 in the direction of arrow 27 in FIG. 4 will withdraw knife blade 11 from sheath 30 on the inner surface of belt 22. The decorative plate 10 functions as a handle for the knife 11 when removed from the belt. If blade 11 was rigidly attached to plate 10, as in the prior art, it would restrict outward movement of stud 20 impending removal of knife 11 from its sheath 30.

The decorative plate 10 and its appended knife blade 11 play no part in holding the ends 31 and 32 of belt 22 together, it being noted that retaining stud 20 penetrates only the end portion 31 of belt 22. The end portions 31 and 32 are held together about the waist of a wearer by strips of thistle cloth or VELCRO 33 and 34 on the inner surface of end portion 31 and the outer surface of end portion 32. The VELCRO strip 33 forms the inner surface of sheath 30 and has an opening in its outer end to receive knife blade 11.

Figure 6:
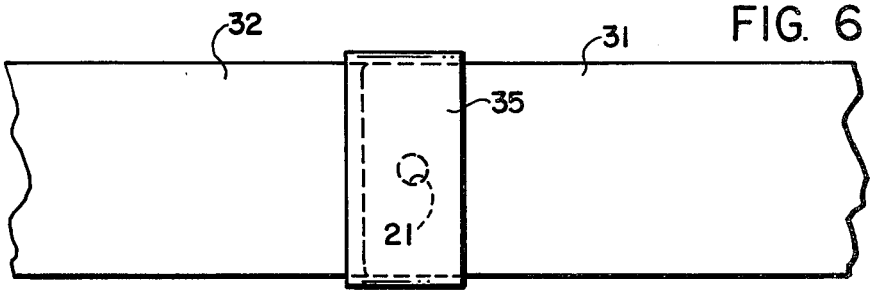
FIG. 6 is a plan view looking at the outer side of the belt and showing the belt loop positioned to conceal the retaining hole when the belt is used without the simulated belt buckle.

The belt 22 may be worn without the decorative plate 10 and its appended knife 11 utilizing the VELCRO strips 31 and 32 and a retaining band 35 to conceal retaining hole 21 (FIG. 6).

In order to retain the band 35 on the belt when not in use the band 35 may be attached to or formed integral with a strap 36 which penetrates a loop 37 fastened to the inner surface of belt end portion 32. The strap 36 terminates in an enlarged end portion 28 which will not pass through the loop 37, thereby retaining the band 35 on the belt 22 when not in use.

There is thus provided a decorative and useful belt accessory wherein the pivotal connection of the knife blade with the decorative plate enables the knife to be instantly removed from its concealed position at any moment of need.

Although specific terms have been used in the specification they are used in a descriptive sense only and not for purposes of limitation.

I claim:

1. A simulated belt buckle and appendage comprising a decorative plate having a free end, an appendage including an elongated portion extending beyond the free end of the decorative plate, a sheath for housing the appendage, means normally retaining the appendage within the sheath, and means pivotally interconnecting the decorative plate and the appendage to permit relative movement between the decorative plate and the appendage during removal of the appendage from the sheath, whereby said removal is facilitated.

2. A structure according to claim 1 wherein said belt buckle includes two oppositely disposed side walls and said pivotal connection comprises a lug extending perpendicularly from said appendage and a pivot pin extending through said lug and journaled in said side walls.

3. A structure according to claim 1 wherein resilient means extend between the decorative plate and the appendage and normally urging the free end of the decorative plate toward the appendage.

4. In combination, a belt having a first end and a second end and adapted to encircle a person's waist, intermeshing means of the outer surface of the first end and on the inner surface of the second end for releasably connecting the ends of the belt, a sheath on the inner surface of said second end portion of the belt and said sheath having an opening extending toward the second end of the belt, the second end portion of the belt having a locking hole therethrough between said second end and the sheath openings, and a simulated belt buckle comprising a decorative plate and an appendage connected to the decorative plate and extending therefrom, a retaining stud extending inwardly from the decorative plate an engagable with said locking hole to normally support the plate on the belt with the appendage housed within the sheath, means for pivotally connecting said appendage to the decorative plate to permit relative movement between the decorative plate and the appendage during removal of the retaining stud from the locking hole, whereby said simulated belt buckle may be removed from the belt without disturbing the connection between the ends of the belt.

5. The combination of claim 4 wherein said belt buckle includes two oppositely disposed side walls and wherein said means comprises a lug extending perpendicularly from said appendage and a pivot pin extending through said lug and journaled in said side walls.

6. The combination of claim 4 which additionally includes a retaining band encircling the belt and means for keeping the band on the belt.

7. The combination of claim 6 wherein said means comprises a loop fastened to the inner surface of the belt, a strap penetrating the loop and extending in parallel relation to the longitudinal axis of the belt, means connecting one end of the strap to the retaining band, and an enlarged end portion on the other end of the strap which will not pass through the loop.

8. The combination of claim 4 which additionally includes resilient means extending between the decorative plate and the appendage and normally urging the retaining stud toward the appendage and into said locking hole.

* * * * *